United States Patent [19]

Ranzen et al.

[11] 4,298,425

[45] Nov. 3, 1981

[54] METHOD AND APPARATUS FOR REFINING LIGNOCELLULOSE-CONTAINING MATERIAL TO PRODUCE FIBER PULP

[75] Inventors: Carl-Olov B. Ranzen, Bromma; Knut O. Danielsson, Stockholm, both of Sweden

[73] Assignee: Defibrator Aktiebolag, Stockholm, Sweden

[21] Appl. No.: 33,119

[22] Filed: Apr. 25, 1979

[30] Foreign Application Priority Data

May 3, 1978 [SE] Sweden ..... 78051331

[51] Int. Cl.[3] ..... D21D 1/30

[52] U.S. Cl. ..... 162/18; 162/23; 162/28; 162/261; 241/28; 241/246

[58] Field of Search ..... 162/28, 18, 56, 261, 162/23; 241/28, 161, 246; 198/661, 670; 100/117

[56] References Cited

U.S. PATENT DOCUMENTS

| | | | |
|---|---|---|---|
| 2,556,391 | 6/1951 | Hawk | 198/670 |
| 2,663,405 | 12/1953 | Messing | 198/213 |
| 3,446,699 | 5/1969 | Asplund et al. | 162/19 |
| 3,661,328 | 5/1972 | Leask | 241/28 |
| 3,921,918 | 11/1975 | Peterson | 162/28 |
| 3,943,034 | 3/1976 | Wallen | 162/261 |
| 4,003,304 | 1/1977 | Reinhall | 100/117 |
| 4,012,279 | 3/1977 | Selander et al. | 162/18 |
| 4,059,237 | 11/1977 | Mannstrom | 162/261 |
| 4,074,803 | 2/1978 | Kollberg | 198/670 |
| 4,088,528 | 5/1978 | Berger et al. | 241/28 |
| 4,236,665 | 11/1980 | Reinhall | 162/28 X |

FOREIGN PATENT DOCUMENTS

| | | | |
|---|---|---|---|
| 2729348 | 1/1978 | Fed. Rep. of Germany | 241/161 |
| 2825069 | 12/1978 | Fed. Rep. of Germany | 162/28 |

*Primary Examiner*—S. Leon Bashore
*Assistant Examiner*—Steve Alvo
*Attorney, Agent, or Firm*—Eric Y. Munson

[57] ABSTRACT

Method and apparatus for producing fiber pulp of improved paper-forming characteristics from ligno-cellulose-containing material such as wood chips and the like. The pulp material is subjected to a defibrating process in at least two steps. In the first step, the pulp material is disintegrated in a defibrator to form a flocculent mass of initially separated and freed fibers. This flocculent mass is then passed through a screw compacting device in which it is subjected to compression of a magnitude of 1 to 5 times the volume of the initially separated fibers. The compressed and highly concentrated mass of initially separated fibers is then passed into a refiner wherein the fibers are finally separated and fibrillated to form the final pulp.The refining is performed at a dry content of about 25-30%.

7 Claims, 4 Drawing Figures

METHOD AND APPARATUS FOR REFINING LIGNOCELLULOSE-CONTAINING MATERIAL TO PRODUCE FIBER PULP

BACKGROUND OF THE INVENTION

The present invention relates to a method and a device for use in the manufacture of fibre pulp from lignocellulose-containing material in the shape of wood chips and the like, which is subjected to disintegration between grinding members in grinding apparatuses in at least two steps. In the grinding apparatus of the first step which also is denominated defibrator, the starting material such as the wood chips is given a disintegration such that the individual fibres in the chips are set free from one another to a substantial degree. The material to be processed then has cotton wool or wadding-like character and is given in the grinding apparatus of the second step, also denominated refiner, an additional disintegration such that the individual fibres are also fibrillated i.e. that their fibrils are separated from each other. The final fibre pulp now has properties suitable for making, e.g. paper, board and the like. The grinding apparatuses may to advantage be of the disc type as e.g. is disclosed in the U.S. Pat. No. 3,212,721.

SUMMARY OF THE INVENTION

The invention is directed to a pretreatment of the fibre pulp preceding the second step with the result that the pulp can be refined at a higher concentration than has been practiced hitherto with the aim of making it possible to carry the refining operation to lower freeness without incurring fibre cutting. This is substantially attained by causing the material to be processed, which, after the first step, has its fibres substantially separated from one another prior to being refined in the grinding apparatus for the second step, to pass through a compacting screw within which it is subjected to a compression of a magnitude amounting to 1 to 5 times and preferably 2 to 4 times its volume in free state.

Surprisingly, it has come out that paper made after this compacting of the pulp acquires a substantially improved strength. According to the invention, the charge of the refiner can be considerably increased, considerably while the production is maintained, which thus implies that the pulp fibres are subjected to an improved decomposition into fibrils. A device suited for carrying out the method is distinguished by the feature that the screw or a portion thereof is formed with threads which together with an encasing cover form thread interspaces which in the direction of movement of the material to be processed have a cross section decreasing in the relation from 1:2 to 1:5 and preferably from 1:3 to 1:5.

BRIEF DESCRIPTION OF THE DRAWINGS

The invention shall be nearer described below with reference to an embodiment shown by way of example in the attached drawings, in which connection other features characterizing the invention shall be stated also.

DETAILED DESCRIPTION OF AN EMBODIMENT OF THE INVENTION

Figure 1:
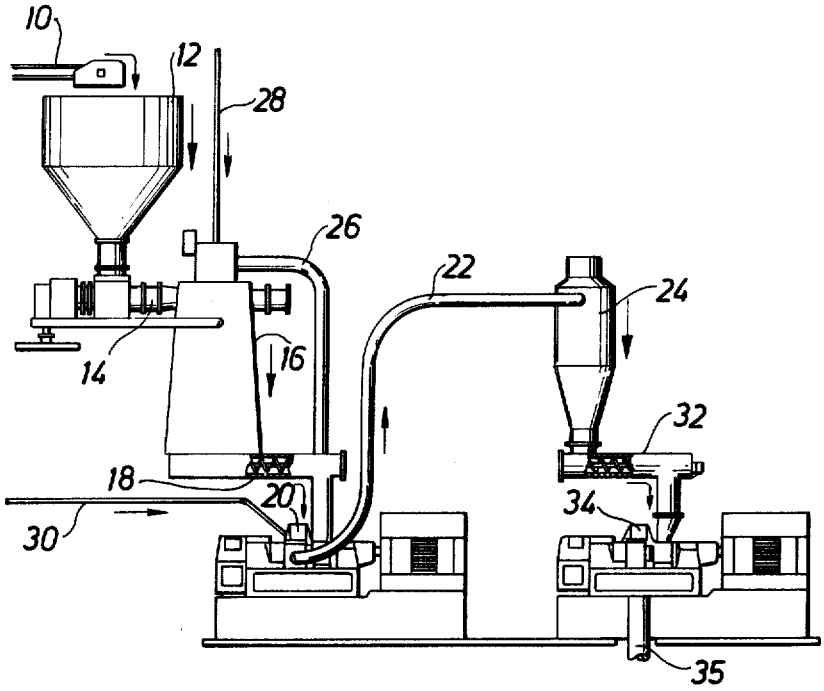
FIG. 1 shows diagrammatically an example of a defibration plant to which the invention is advantageously applicable to advantage.

Referring now to FIG. 1, reference numeral 10 denotes a conveyor on which the starting material, such as wood chips, is supplied to a funnel-shaped vessel, a so-called surge bin 12. A screw feeder 14 which is attached to the bottom of the vessel 12, advances the wood chips to the top portion of a preheater 16, the bottom part of which is connected to the grinding apparatus of the first step or disc defibrator 20 by means of a screw conveyor 18. Here, a first grinding of the wood chips to fibres separated from one another is effected, the separated fibres being blown through a duct 22 in a steam atmosphere into a cyclone 24.

If the plant is operated according to the so-called thermo-mechanical method, as is evident, e.g., from the British Patent Specification No. 1,266,898, the wood chips when entering the defibrator 20 have a relatively high concentration or dry content and between the grinding discs in the defibrator steam is developed, a portion of which can be conducted through a pipe 26 to the top portion of the preheater 16 in order to bring about a preheating or steaming of the chips to a temperature approaching 100° C. Through the pipes 28 and 30 additional steam can be supplied to the preheater or the casing of the defibrator in order when necessary to ensure required steam supply or steam pressure. The temperature of the material to be processed or the steam in the defibrator can run up to 110°-140° C. with a pressure corresponding thereto in the application of the thermo-mechanical method.

In the cyclone 24 the pulp material is separated from the steam which escapes in upward direction while the pulp material falls down to a compacting conveyor screw device formed according to the invention and generally denoted 32, by which the pulp material is fed in its compacted state to the grinding apparatus 34 of the second step and usually denominated refiner, which has an outlet 35 for the finally processed pulp.

Figure 4:
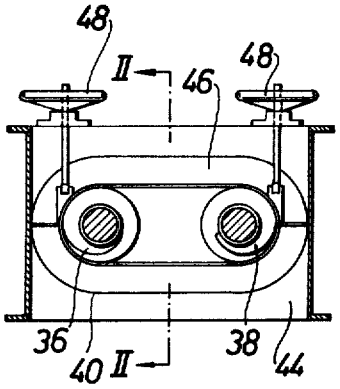
FIG. 3 is a top view of the screw device of FIG. 2 partly in a horizontal section and FIG. 4 shows a section following the line IV—IV in FIG. 2.
Figure 2:
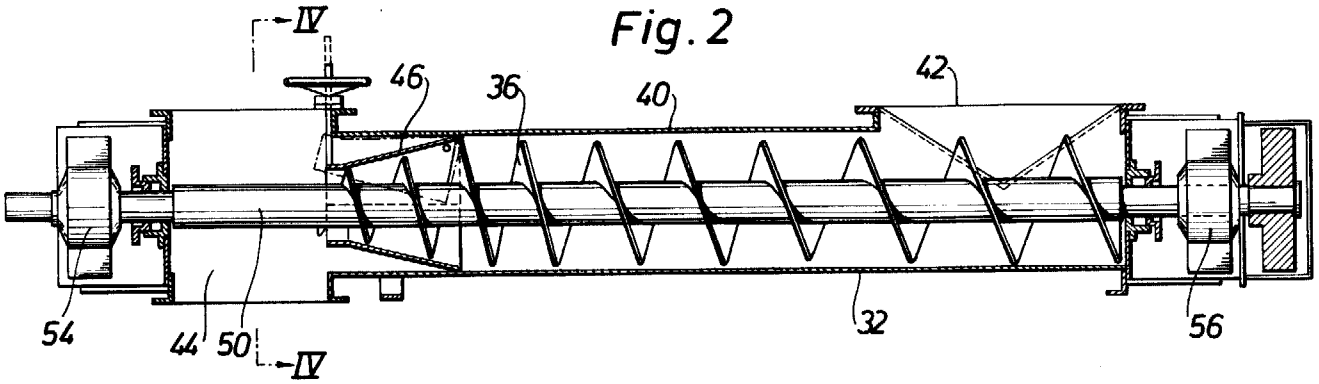
FIG. 2 is a vertical sectional view following the line II—II in FIG. 4 through a compacting screw device suited for realization of the method of the invention.
Figure 3:
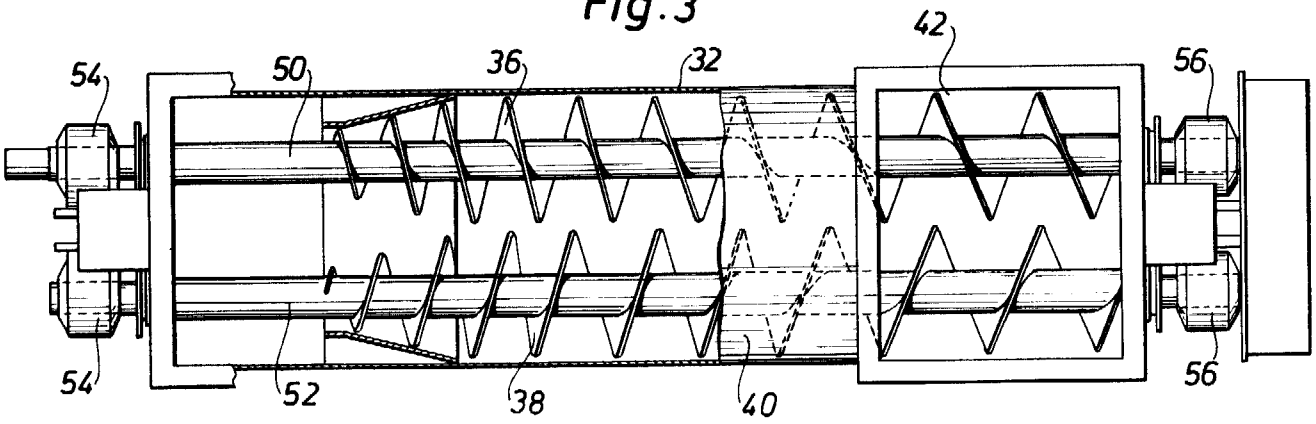

The compacting screw device may comprise a twin screw as will be seen from the FIGS. 2-4. The two counter-revolving screws 36, 38 are enclosed by a common casing 40 with inlet opening 42 for fibre pulp from the cyclone and an outlet 44 leading to the grinding discs of the refiner. The two screws 36, 38 have over the major part of their length counted from the inlet 42 threads with constant outer diameter, whereas the pitch gradually diminishes towards the outlet. When the cotton wool or wadding-like pulp material passes through this portion, an initial compacting is effected, which, depending on the degree of filling up at the inlet side from the opening 42, may be greater than 1:1. The two screws change thereupon over into a suitably shorter end portion in which their diameter decreases towards the outlet side. Here, they are surrounded by a tapering cover which in the upper portion forms a flap 46 which is hinged at its rear end and which is adjustable about the same by means of a setting device 48 for varying the gap between the flap and the screws and consequently the degree of compression. At this latter portion of the twin screw a further compacting is effected so that the fibre pulp reaches a final ratio of compression of up to 1:5 to 1:6 of the density it has upon admission into the screw filling up the interspaces between the threads.

Preferably, atmospheric pressure prevails in the inlet to the screws as well as in the refiner.

The counter-rotating shafts 50, 52 of the screws are driven synchronically by a motor not shown. The shafts are at their ends supported by bearings 54, 56.

The decrease of volume which is imparted to the thread interspaces in the direction from the inlet to the outlet may amount to 1:3 up to 1:5. As mentioned, the degree of compaction is, of course, dependent on the furnished quantity of pulp and the degree of fill at the inlet side connected therewith. The aforestated values mean that the fibres, which are loosely flocked together when entering the twin screw device, fill up the thread interspaces. As mentioned, the surprising effect is obtained according to the invention, in that the refining operation can be performed with a higher concentration, with a dry content of the material to be processed of e.g. 25–30% against 18% normally, which in turn results in the feature that the refining operation can be driven to lower freeness without thereby exposing the fibres to any appreciable cutting losses. Thus, in tests the fibre pulp has been refined to 120 ml CSF (Canadian Standard Freeness), wet strength 80, against normally 200 ml CSF, wet strength 60. This highly improved grinding result is probably partly attributable to the cotton wool or wadding-like fibrous material being compressed in the screw device 32 to such an extent that the steam generated between the grinding discs of the refiner is permitted to flow backwards without interfering with the constant supply of pulp material to the refiner.

Obviously, the invention is not limited to the shown embodiment, but may be varied in many respects within the frame of the basic idea thereof.

We claim:

1. In the method of producing pulp from lignocellulosic fibrous material in which the material is first subjected to a grinding operation in a steam pressurized defibrating apparatus of the rotating disc type and the resultant mass of separated fibers is blown by the accompanying steam into a steam separator where the steam is separated from the fiber mass to form a cottony wadding-like fiber mass suspended in a gaseous atmosphere and passed to a refiner of the rotating-disc type via a screw conveyor means rotating within a housing, the improvement enhancing the freeness and wet strength characteristics of the pulp, comprising:

compacting said cottony wadding-like fiber mass during its passage through said housing by compressing it by said screw conveyor means to a ratio between 1:2 and 1:6 so as to permit steam generated between the discs of said refiner to escape through said conveyor means housing without interfering with the constant supply of fiber mass to the refiner and to permit the refining to be performed at a dry content of about 25–30%.

2. The method according to claim 1, in which the fluffy cotton mass is compacted in gaseous atmosphere at atmospheric pressure.

3. In an apparatus for producing pulp from lignocellulosic fibrous material in which the material is first ground in a steam pressurized defibrator and the resultant mass of separated fibers blown by the accompanying steam into a steam separator where the steam is separated from the mass of separated fibers in the form of a cottony wadding-like fiber mass suspended in a gaseous atmosphere and passed to a further refiner of the rotating-disc type via a screw conveyor means rotating within a housing, the improvement comprising:

a screw conveyor means provided with screw flights calibrated relative to the housing so as to compress the cottony wadding-like fiber mass at a ratio between 1:2 and 1:6 during its passage through the housing so as to permit steam generated between the discs of said refiner to escape into said conveyor means housing without interfering with the constant supply of fiber mass to the refiner and means to permit the refining to be performed at a dry content of about 25–30%.

4. Apparatus according to claim 3, in which the screw flights together with the surrounding housing form an interspace which in the direction of flow of the fiber mass has a cross section decreasing in a ratio between 1:2 and 1:6.

5. Apparatus according to claim 4, having at least one adjustable flap pivoted to the interior wall of the housing at the end proximate to the further pulp-preparation apparatus for additionally regulating the ratio of compression.

6. Apparatus according to claims 3, in which the screw conveyor means comprises twin screws.

7. Apparatus according to claims 3 or 5, in which the flights of the screw means have a portion of constant diameter proximate the inlet and a portion of progressively decreasing diameter proximate the further pulp preparation apparatus.

* * * * *